US005173140A

United States Patent [19]

Vasilakes

[11] Patent Number: 5,173,140

[45] Date of Patent: Dec. 22, 1992

[54] TAPE APPLYING DEVICE AND METHOD FOR APPLYING TAPE

[75] Inventor: Lloyd S. Vasilakes, North Saint Paul, Minn.

[73] Assignee: Minnesota Mining and Manufacturing Company, Saint Paul, Minn.

[21] Appl. No.: 559,696

[22] Filed: Jul. 30, 1990

[51] Int. Cl.[5] ..... B31F 1/72

[52] U.S. Cl. ..... 156/212; 156/216; 156/351; 156/358; 156/360; 156/468; 156/486; 156/522; 53/137.2

[58] Field of Search ..... 156/351, 353, 355, 360, 156/465, 468, 475, 486, 522, 196, 199, 250, 358, 212, 216; 53/75, 76, 137, 137.2

[56] References Cited

U.S. PATENT DOCUMENTS 3,915,786 10/1975 Collett et al. ..... 156/355
3,954,550 5/1976 Patterson ..... 156/486
4,238,269 12/1980 Deering, Jr. ..... 156/465
4,548,022 10/1985 Yaklin ..... 53/415
4,640,731 2/1987 Lerner et al. ..... 156/355

*Primary Examiner*—David A. Simmons
*Assistant Examiner*—J. Sells
*Attorney, Agent, or Firm*—Kinney & Lange

[57] ABSTRACT

A device and method for applying a length of pressure-sensitive adhesive tape to an object that is moved along a path past the device is described. The device includes a frame and a mechanism for applying the length of tape to the periphery of the object that is attached to the frame. The mechanism for applying the length of tape is movable between a first tape dispensing position and a second tape dispensing position and wherein the mechanism dispenses the tape along a forward and a rearward portion of the object while in the first position and dispenses tape at the second position between the forward and rearward portions of the object. A retaining mechanism restricts movement of the means for applying toward the object while in the second position.

11 Claims, 7 Drawing Sheets

TAPE APPLYING DEVICE AND METHOD FOR APPLYING TAPE

BACKGROUND OF THE INVENTION

The present invention relates to devices for applying lengths of pressure-sensitive adhesive-coated tape to objects such as boxes.

Examples of devices for applying adhesive coated tape are described in Collet et al U.S. Pat. No. 3,915,786, Patterson U.S. Pat. No. 3,954,550, and Deering, Jr. U.S. Pat. No. 4,238,269. Such devices are commonly used to seal boxes filled with merchandise. The boxes are driven past the device by a conveyor. Typically these devices include an application member such as a roller for supporting an end of the tape with the adhesive side disposed outwardly in a contact position such that the tape end contacts the box moving towards the tape. Upon such contact, the tape end adheres to the box. As the box moves, the box pulls the tape from the device and the application member presses the tape against the contour of the box. As the box moves past the device, the applied length of tape is severed from the supply length of tape. The tape adjacent a newly severed end with the application member is moved back to its initial contact position for contact by the next box on the conveyor.

The Collet et al U.S. Pat. No. 3,915,786 and the Patterson U.S. Pat. No. 3,954,550 describe devices that have pivotally mounted application members. The application member has one end of an arm pivotally mounted at one edge of the path of the boxes. After the leading surface of the box contacts the tape on the application member, the application member revolves about a pivot point to follow the contour of the box and presses the tape sequentially against the leading surface of the box, then along a top surface of the box defined by adjacent edge portions of abutted cover flaps of the box, and then over a trailing surface of the box. The force applied by the leading surface of the box to move the application member across its leading surface increases significantly as the application member approaches the edge of the box. This force can become large enough to push in the leading wall of the box under the box's two cover flaps, particularly for lightly constructed boxes.

The Deering, Jr. U.S. Pat. No. 4,238,269 describes a linearly retractable application member that applies tape at a uniform pressure solving the problem caused by the increasing forces of the pivotally mounted application member. The linearly retracted bolt application member is moved by movement of the box along a generally linear path from a contact position at which the application member is contacted by a leading surface of the box to a second position at which it will be held against one side of the box as the box moves passed the member. The force applied by the leading surface of the box to move the application member to its second position is essentially uniform as the application member traverses the leading surface of the box thereby avoiding pushing in the front wall of the box.

However, even with the uniform pressure applied by a linearly retractable application member, problems have occurred with long, large, or thin-walled constructed boxes or boxes with contents that do not provide support to the edge portion of the cover flaps that are being taped. In both cases, the cover flaps cannot support the force applied by a pivotally mounted application member or a linearly retractable application member. As the application member leaves the leading edge of the box and approaches the mid-section of the box, the force spreads the cover flaps apart from each other. The result is that the tape is not applied properly. In some instances, the application member spreads the cover flap so far apart that the application member breaks through into the interior of the box. On some occasions, the application member breaks through sufficiently into the interior of the box to set off the tape severing mechanism, prematurely severing the tape.

SUMMARY OF THE INVENTION

The present invention includes a device and method for applying a length of pressure-sensitive adhesive tape to an object such as a box and is especially suitable for applying tape to cover flaps of long, large or thin-walled boxes or cover flaps that are unsupported by the interior contents of the box. Using the device of the present invention, the cover flaps do not spread apart and are taped in a substantially abutting relationship with each other.

The device includes a frame and a mechanism for applying the length of tape to a periphery of the object. The mechanism for applying is mounted within the frame and is movable between a first tape dispensing position and a second tape dispensing position. The mechanism for applying dispenses the tape along a forward and a rearward portion of the object while in the first dispensing position and dispenses at the second dispensing position, a portion of the tape between the forward and rearward portions of the object. A retaining mechanism retains the mechanism for applying tape in the second dispensing position such that the movement of the mechanism for applying towards the object is restricted.

The present invention also includes a method for applying a length of pressure-sensitive adhesive tape to an object moving along a predetermined path. The method includes applying a first portion of a length of tape to a first leading surface of an object and then applying a second portion of the length of tape to a mid-portion of the object. An application mechanism whose movement towards the box is restricted during application of the second portion of the tape applies tape to an object such as a box having cover flaps, the cover flaps are not spread apart by the application mechanism resulting in the cover flaps being taped in a substantially abutting relationship. The remaining portion of the tape is then applied to a trailing surface of the object.

DETAILED DESCRIPTION OF THE PREFERRED EMBODIMENTS

Figure 1:
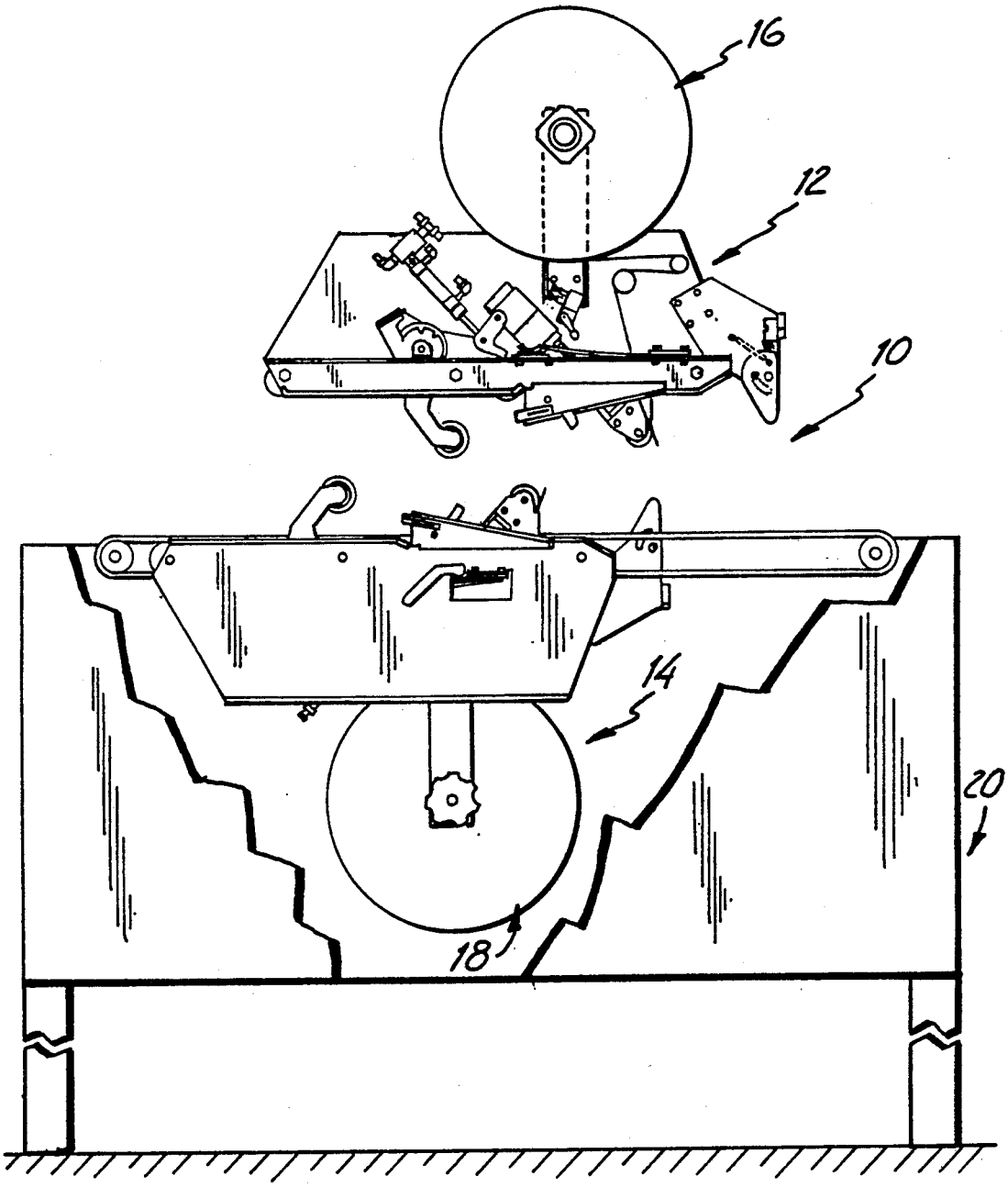
FIG. 1 is a side view of a machine incorporating two tape-applying devices of the present invention.

A machine generally indicated at 10 of the present invention is illustrated in FIG. 1. The machine 10 incorporates two tape-applying devices 12 and 14. The Deering, Jr. U.S. Pat. No. 4,238,269 describes a tape applying device having a linearly retractable application member that is suitable for use with the present invention and is hereby incorporated by reference. The present invention may also be used with tape applying devices having pivotally mounted application members. A commercially available example of an apparatus that can use the present invention is a taping head sold under the trademark HST by Minnesota Mining and Manufacturing Company of St. Paul, Minn.

The devices 12 and 14 are positioned to apply lengths of pressure-sensitive adhesive coated tape from supply lengths of tape 16 and 18, respectively, seriatim around the periphery of an object such as a rectangular box (illustrated in FIGS. 4–7) that travels along a predetermined path through the machine 10.

The machine 10 includes a base portion 20 supporting the tape-applying device 14. A conveying mechanism is adapted to move a box placed along the path and past the devices 12 and 14. The device 12 is supported by a vertically movable frame portion (not shown) that is adapted to move vertically to bring the uppermost device 12 into contact with the top surface portions of the box while the box is being moved through a machine 10.

The devices 12 and 14 of the machine 10 function in the same manner and have essentially the same parts. Both devices 12 and 14 will be described with reference to the device 12 illustrated in FIGS. 2–7 with the understanding that the parts of the device 14 are disposed in mirror image positions with respect to corresponding parts of the device 12. The device 12 is mounted to apply tape to a top surface of the box. The device 14 is mounted to apply tape to a bottom surface of the box.

Figure 2:
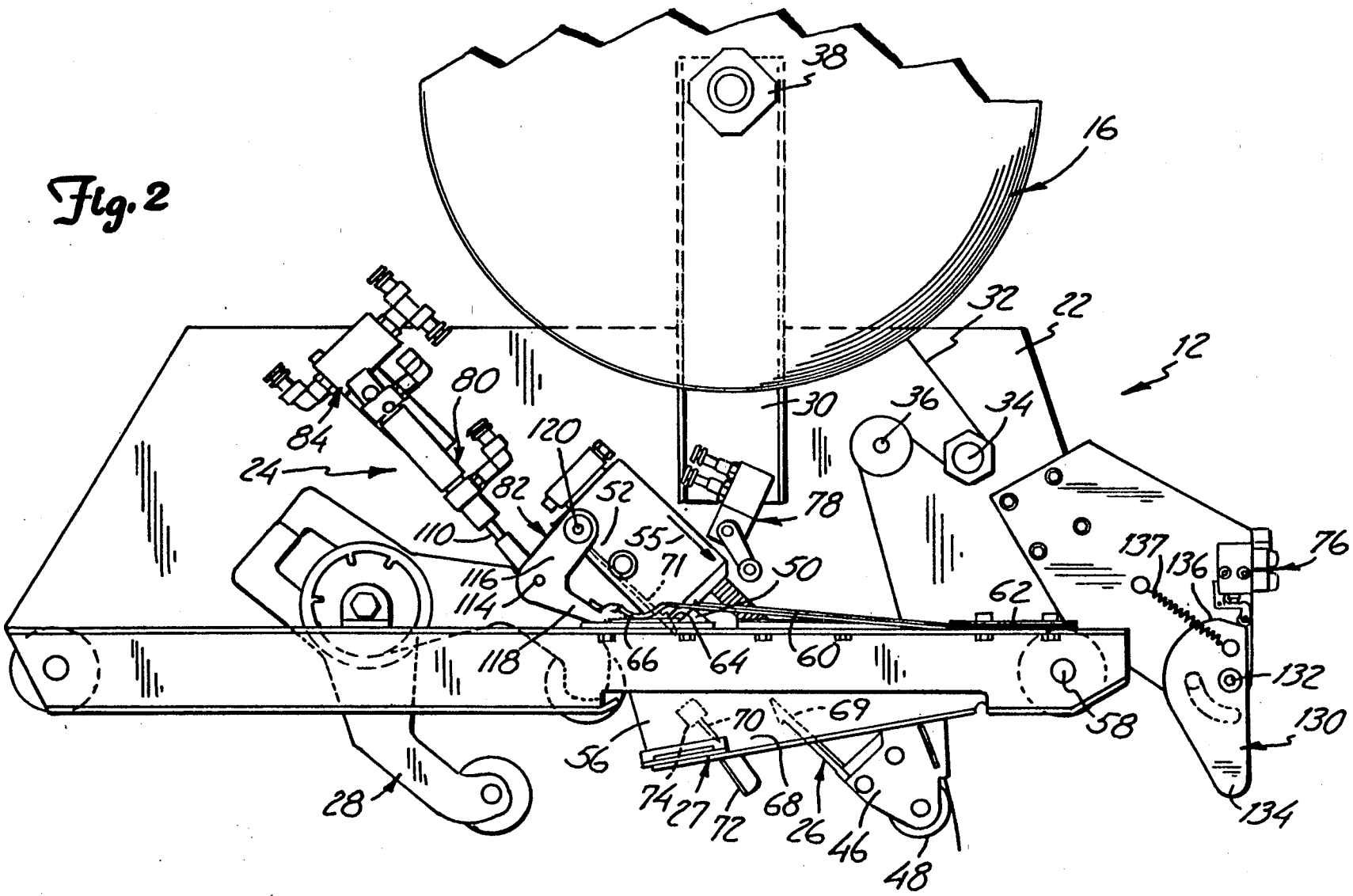
FIG. 2 is an enlarged fragmentary view of one of the devices illustrated in the machine in FIG. 1.

Referring to FIG. 2, the device 12 includes a frame 22 on which is mounted a supply length of tape 16 for feeding pressure-sensitive adhesive tape 32 to a tape application mechanism 26. A tape severing mechanism 27 for severing an applied length of tape 32 functions in connection with the tape application mechanism 26. A retaining mechanism generally indicated at 24 is also mounted on the frame 22 and retains the tape application mechanism 26 and the tape severing mechanism 27 in a retracted tape dispensing position, as will be described subsequently. Lastly, a buffing roller 28 is mounted within the frame 22 which firmly buffs the applied length of tape against the box that is moved through the machine 10.

The supply length of tape 16 is rotatably mounted with respect to the frame 22 by a bracket 30. Tape 32 is pulled from the supply length of tape 16 over initially an idle roller 34 and a tension roller 36 to the tape application mechanism 26. The idle roller 34 and tension roller 36 define a tape route to the application mechanism 26. The supply length of tape's rotatable movement is frictionally retarded by a hub 38. The tension roller 36 has a knurled surface adapted for releasable contact with the adhesive side of the tape.

The application mechanism 26 includes a yoke 46 in which an application roller 48 is rotatably mounted. The yoke 46 is mounted on a lower end of a pair of parallel rods 50 whose upper end projects into a pair of linear bearings 52. The linear bearings are fixed to the frame 22 for axial sliding movement of the application roller 48. Gravity provides a biasing force in the direction of arrow 55 to the application roller 48 for tape applying device mounted over the box as illustrated in FIG. 2. A spring may also be used. If the tape applying device is mounted to apply tape to a bottom surface of the box, then a spring is provided as the biasing force.

The mechanism for severing an applied length of tape from the supply length of tape 16 includes a blade bracket 56 pivotally attached to the frame 22 by a pivot pin 58. The blade bracket 56 is biased downwardly in a normal position by a leaf spring 60 attached to the frame 22 at a first end 62. The leaf spring 60 acts against a tab member 64 of the blade bracket 56 with a free end 66. The blade bracket 56 has a general U-shaped cross section that is defined by generally parallel side walls 68 (only one side wall being illustrated). The side walls 68 are spaced to receive the tape 32 therebetween.

A mechanical latch 69 and catch 71 secures the application member 26 in a retracted position. The latch 69 is fixed to the application member 48. The catch 71 is pivotally attached to the housing of the linear bearings 52. The blade bracket 56 acts on the catch 71 when in a lowered position to release the latch 69 therefrom.

A knife 70 is fixed between the side walls 68. A knife guard 72 is pivotally mounted between the side walls 68 by pivot pin 74 to afford movement of the guard 72 between a safety position adjacent an edge of the knife (to which safety position the guard 72 is biased by a spring (not shown) at the pivot point 74) and a position spaced from a cutting edge of the knife 70 through contact of a distal portion of the guard that extends past a lower surface of the blade bracket 56 and contacts the box moving through the machine 10. The guard 72 also has sufficient length to extend beyond a distal end of the blade bracket 56 so that the guard 72 remains in contact with a box moving through the machine after the lower surface of the blade bracket 56 has lost contact with the box. When such contact is lost, the blade bracket 56 will return to its normal position under the influence of the leaf spring 60 while the guard 72 remains retracted from the cutting edge of the blade 70 through contact with the box so that the cutting edge of the blade 70 will engage and sever a length of tape extending between the trailing edge of the box and the application roller 48.

The retaining mechanism 24 includes a first valve 76, a second valve 78, a pneumatic cylinder 80, a four-way valve for operating the pneumatic cylinder, and a retaining arm 82 moved by the pneumatic cylinder for retaining the application roller 48 in a retracted position. The pneumatic cylinder 80 is activated by a pneumatic circuit, illustrated in FIG. 3, that is controlled by valves 76 and 78. The valves 76 and 78, when activated, control operation of the four-way valve 84 such that air flow is controlled into the pneumatic cylinder 80. The valves 76 and 78 are three-way, two position valves that are actuable by the box moving through the machine 10. A pressurized air source 86 operates the four-way valve and is interrupted when either one or both valves 76 and 78 are biased by springs 88 and 90, respectively, to their normal position.

When a box moves through the machine 10, the valve 76 is actuated in the direction of arrow 92 permitting air to flow through a passage indicated by arrow 94 in the valve 76. Similarly, when the box actuates the switch 78, the valve is actuated in the direction of arrow 96 so that pressurized air flows from source 86 through a passage represented by arrow 98. Once the valve 78 is actuated, the pressurized air operates the four-way valve 84 by actuating the valve in the direction of arrow 100 against spring 102.

A second pressurized air source 104 provides air into a passage represented by arrow 106 in the valve 84 so that pressurized air is introduced into the pneumatic cylinder 80 on a side of the piston 108 that urges the piston rod 110 in a retracted position. When the valve 84 is actuated in the direction of arrow 100, the pressurized air 104 then flows through a channel 112 and into the pneumatic cylinder 80 to a side of the piston 108 that urges the piston rod 110 to an extended position.

Therefore, when both valves 76 and 78 are actuated, the pressurized air then actuates the valve 84 to position the rod 110 of the pneumatic cylinder in the extended position. Actuating either valve such as the valve 76 in an opposite direction actuates the valve 84 in an opposite direction and moving the rod 110 back into the cylinder to the retracted position.

As illustrated in FIG. 2, the piston rod 110 is pivotally connected to the retaining arm 82 at a pivot point 114. The retaining arm 82 includes a proximal arm section 116 and a distal arm section 118. The proximal arm section 116 is pivotally secured at pivot point 120 to the outside surface of the linear bearings 52. When the piston rod 110 is disposed in the extended position, the piston rod 110 pivots the retaining arm 82 about the pivot point 120, as will be described subsequently, to a retaining position. When the piston arm is retracted, the retaining arm 82 is pivoted from the retaining position to an non-retaining position.

Figure 4:
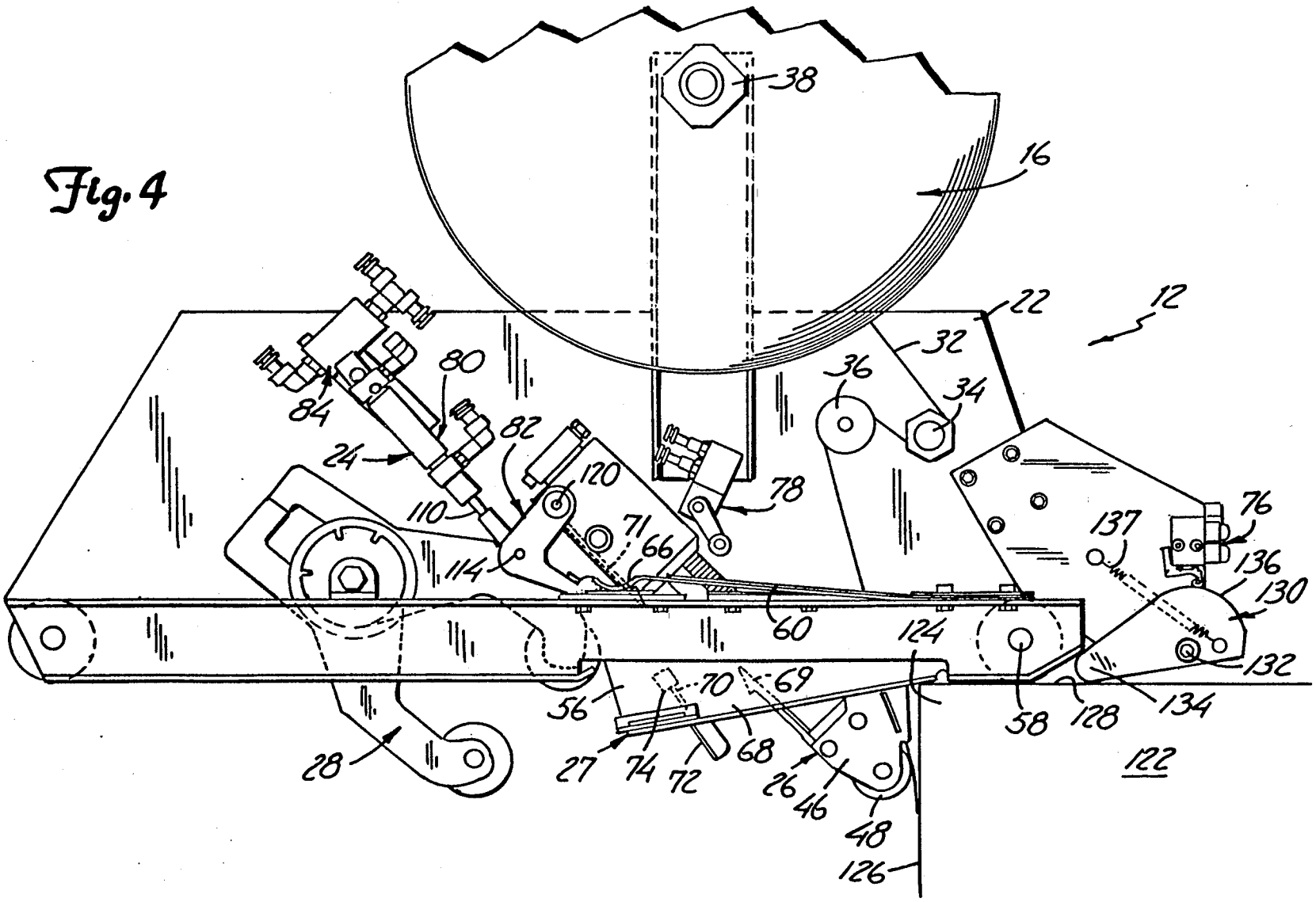
FIGS. 4, 5, 6, and 7 are enlarged fragmentary views sequentially illustrating the application of tape to a box by one of the devices incorporated in the machine illustrated in FIG. 1

Referring to FIGS. 4 through 7, the device 12 of the present invention is illustrated in use. In FIG. 4, a box 122 is illustrated approaching the device 12. The box 122 is a conventional box having a top surface made of two flap panels having adjacent edge portions that require taping in an abutting relationship.

The box 122 initially actuates the valve 76 with a vertical front end wall 126 of a forward portion 124. In the preferred embodiment illustrated, the box actuates the valve 76 through a cammed lever arm 130 that is pivotally mounted to the frame 122 at a pivot point 132. The cammed lever arm 130 includes a cammed surface 136 that actuates the valve 76 to obtain pressurized air flow through the valve, as discussed previously. The lever arm 130 also includes a lower end 134 that is disposed at a lower position, as best illustrated in FIG. 2. The lower end 134 extends low enough so that when the box 122 moves through the machine, the box encounters the lower end 134 and pivots the cammed lever arm 130.

Figure 5:
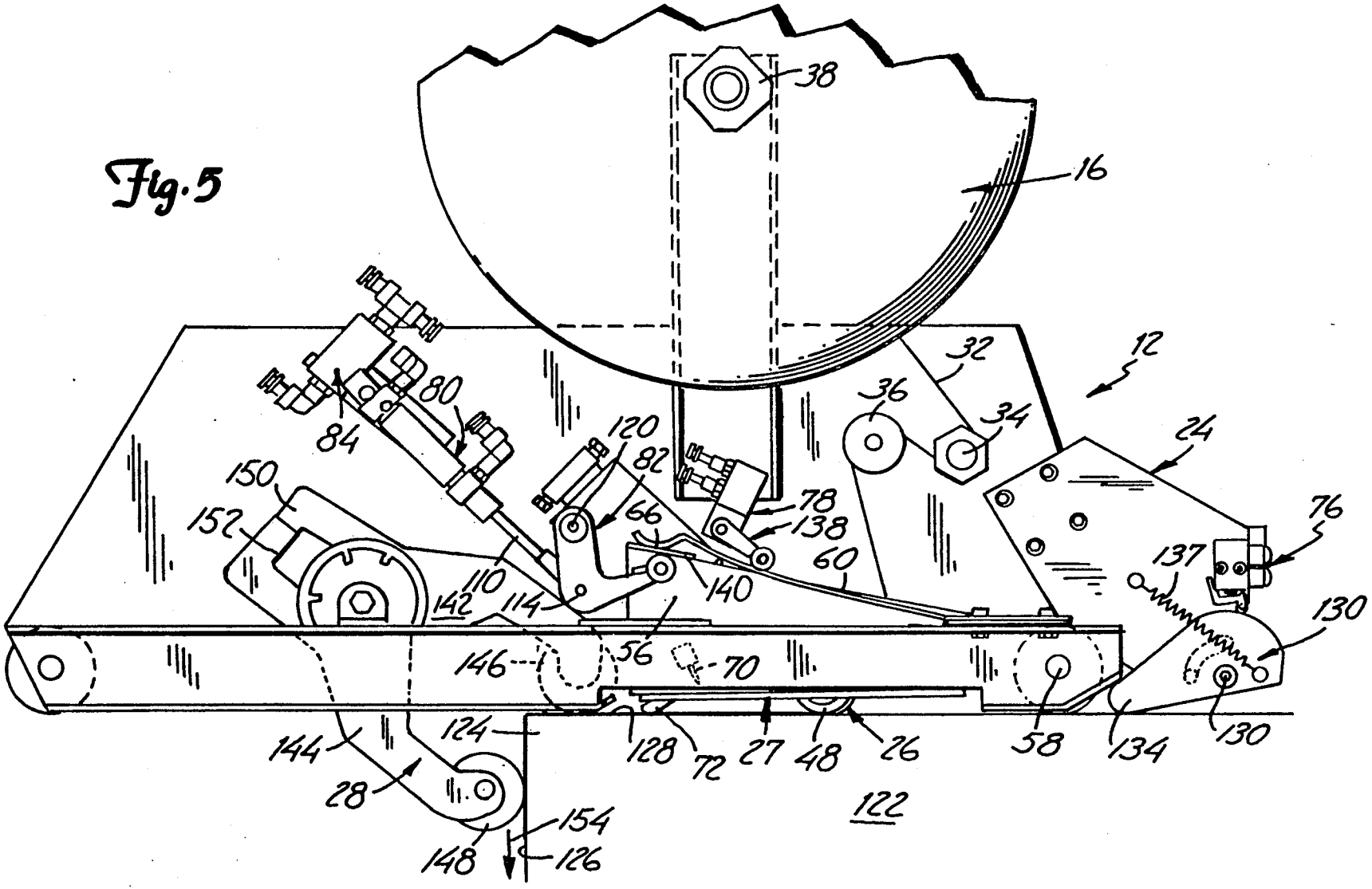

As the box moves past the lever arm 130, the vertical front end wall 126 of the forward portion 124 of the box encounters the application member 26. The tape 32 is disposed adhesive side facing outwardly (towards the box) so that the tape 32 readily adheres to the front surface 126 of the box 122. As the box moves past the application member 26, tape 32 is being applied to the box 122 and the application member is being moved to a retracted position, as best illustrated in FIG. 5. The mechanical latch 69 and catch 71 illustrated in FIG. 2 are engaged to retain the application member in a retracted position.

In addition, the box 122 engages the blade bracket 56 pivoting the blade bracket upwardly about the pivot point 58. In addition, the guard 72 is pivoted away from the cutting edge of the knife 70.

As the blade bracket 56 is pivoted upwardly, the blade bracket 56 engages a lever arm 138 that actuates the valve 78. When the blade bracket 56 has been lifted about 50 percent of the brackets upward travel, the bracket engages the lever arm 138 of the valve 78. Once the valve 78 is actuated, the piston rod 110 is moved to an extended position, pivoting the retaining arm 82 to a retaining position. The retaining arm 82 engages a tab 140 of the blade bracket 56 and lifts the blade bracket along with the application member 26, the remaining portion of travel to a position approximately along the underside of the frame 22 restricting the blade bracket's movement.

Restricting the blade bracket's movement removes the force of the blade bracket from a top surface 128 of the box 122. Removing the force of the blade bracket from the top surface of the box reduces the spreading of the flap panels. If the flap panels of the box spread far enough apart, the blade bracket will extend far enough into the box such that the application mechanism 26 is unlatched since the blade bracket will unlatch the mechanical latch 69 and clasp 71. The result of the blade bracket prematurely moving and unlatching the application roller is that the application roller then pushes through the top of the box and the flap panels of the box are not sealed by the tape. In addition, the premature movement of the blade bracket will often times prematurely cut the tape, providing an inadequate length of tape for sealing.

In one working example for use on single wall corrugated fiber board box number B48 (49 inches long, 26 inches wide, and 26 inches high) available from Stone Container of St. Paul, Minn., the blade bracket is disengaged by the retaining mechanism approximately 12 inches from the trailing edge of the box. This distance may be varied by moving the position at which the first switch is disengaged. In the embodiment illustrated, this distance has ranged from 0.5 to 24 inches. Flap panels in large boxes, or boxes in which the flap panels are not supported or are "soft" due to thin wall thickness will not support the blade bracket. The retaining mechanism of the present invention eliminates the deflection of the flap panels from the force of the blade bracket and avoids the need for reinforcing the box for sealing. It will be understood that the proper distance from the engagement or disengagement of the retaining mechanism to the leading or trailing edge will depend on several factors including but not limited to box size, wall thickness, the speed at which the box is traveling, or to the extent that the interior of the box is filled with product.

The buffing roller 28 is well known in the art. The buffing roller includes first and second buffing arms 142 and 144 which respectively rotatably support buffing rollers 146 and 148 at a distal end. Proximal ends of the first and second arm are fixed on to a shaft that is rotatably mounted on the frame 22. A first coil spring (not shown) is connected between the first and second arms 142 and 144 to bias the arms 142 and 144 relative to each other to a position in which bosses 150 and 152 are in engagement with each other to space apart the buffing rollers 146 and 148. A second coil spring (not shown) biases the first arm 142 toward a start position such that the first buffing roller 146 engages the top surface 128 of the box and the second buffing roller 148 engages the front vertical surface 126 of the box as the forward portion 124 of the box approaches the buffing mechanism 28.

Figure 6:
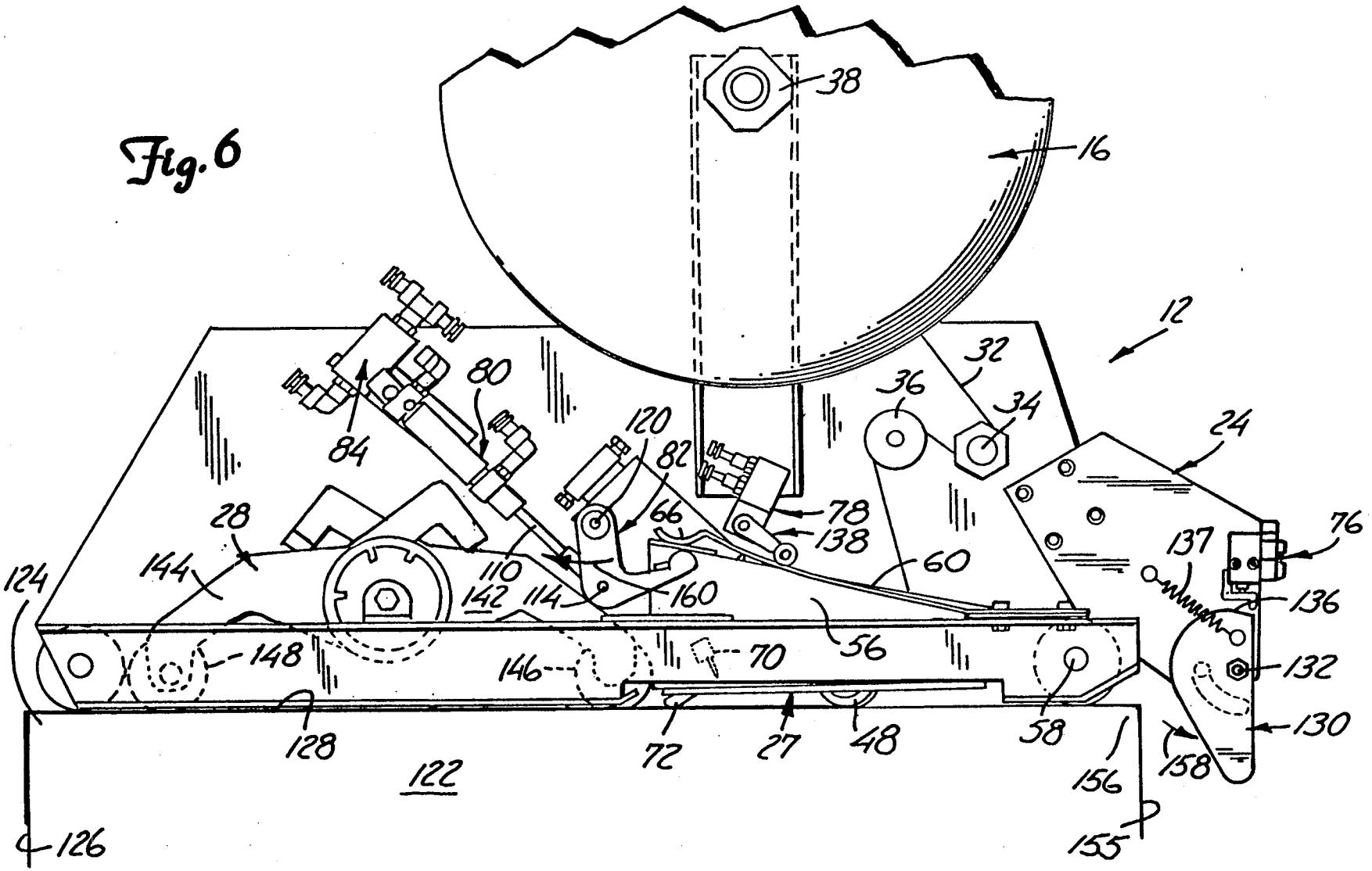
Figure 7:
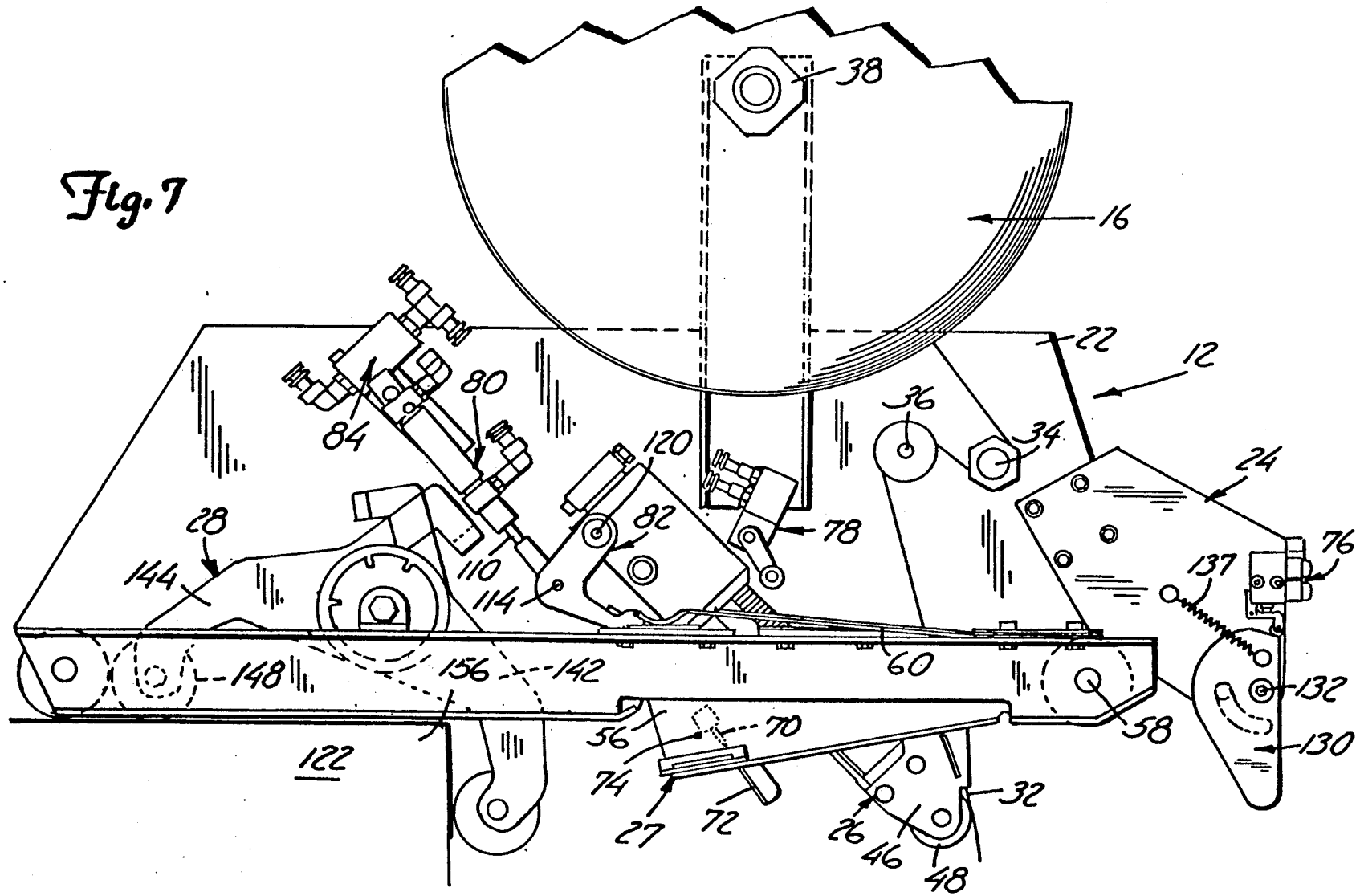

As illustrated in both FIGS. 5 and 6, as the box progresses through the machine 10, the arms 142 and 144 of the buffing roller mechanism spread apart with the buffing roller 148 proceeding downwardly along the vertical front end wall 126 of the box 122, as indicated by arrow 154 while the buffing roller 146 engages the top surface 128 of the box 122. As the vertical front end wall 126 proceeds past the buffing roller 148, both buffing rollers 146 and 148 contact the top surface of the box and act against the tape ensuring that the tape is applied to the box.

As a trailing portion 156 of the box moves past valve 76, the lever arm 130, biased by the spring 137 returns to its normal position, as generally indicated by arrow 158. The movement of the lever arm 130 back to its biased normal position results in the cammed surface 136 actuating the valve 76 to its normal position which interrupts the flow of pressurized air to the four-way valve 84. With the interruption of the pressurized air to the four-way valve 84, the piston rod 110 is moved back to the retracted position, thereby pivoting the retaining arm 82 as indicated by arrow 160, to a non-retaining position. With the retaining arm 82 moved to an non-retaining position, the blade bracket 56 moves downwardly to contact the top surface of the box 122. However, since the blade bracket touches the top flap panels of the box relatively close to the rear vertical end wall 155 of the trailing portion 156 of the box (such as 12 inches in the illustrated embodiment), the blade bracket receives relatively more support and the top flap panels are able to withstand the force being applied by the blade bracket 56, resisting separation or deflection by such force.

Figure 3:
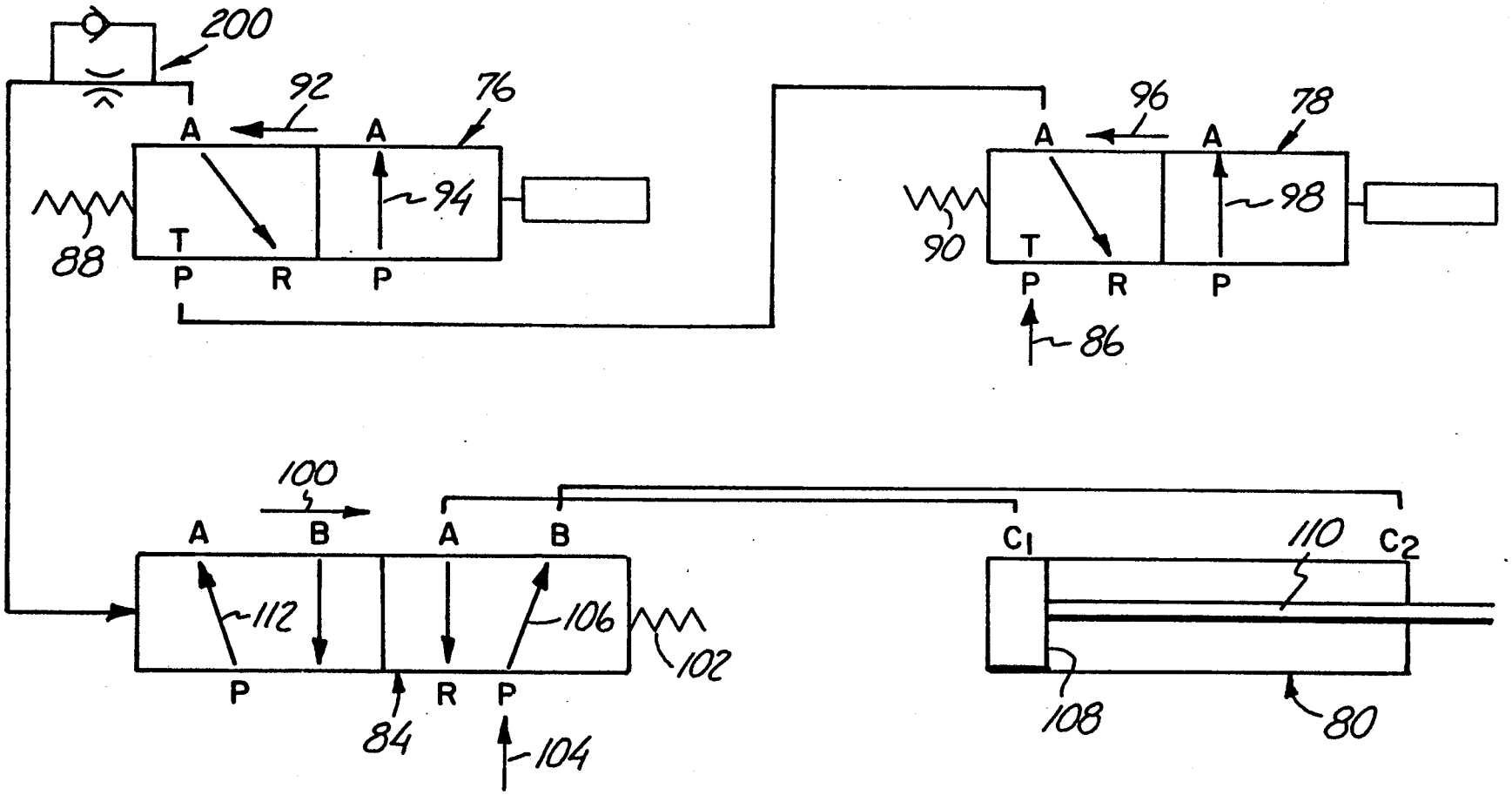
FIG. 3 is a schematic view of a pneumatic circuit of the present invention.

Alternatively, the position at which the blade bracket falls and engages the surface of the box and disengages the latching mechanism can be controlled by an optional flow control valve 200 as illustrated in FIG. 3. As previously discussed, the position at which the blade bracket falls and engages the surface of the box may be varied by moving the position at which the first switch is disengaged. However, the practical range for this distance is 0.5 to 24 inches for the embodiment illustrated in the figures. The flow control valve 200 provides additional or alternative methods of varying the position at which the blade bracket falls and touches the box.

After the first switch 76 is disengaged from the box through lever arm 130, the flow control valve 200 controls the rate at which the air is exhausted between the four-way valve 84 and the valve 76. Restricting the rate at which the air is exhausted will delay the lowering of the bracket arm and the unlatching of the mechanical latch 69 and the clasp 71. The flow control valve 200 can be used alone or in combination with repositioning of the lever arm 130 to control at which point in time the blade bracket is allowed to move.

As the trailing portion 156 of the box moves past the blade bracket 56 and the application mechanism 26, the tape 32 is severed by the knife 70 in a manner well known in the art. The knife guard 72 pivots back into position, and the buffing roller 146 engages the severed end of the tape and applies the tape to the vertical rear end wall 155 of the box 122.

As will be understood, the bottom of the box 122 is also simultaneously taped, if that is desired, by the device 14. Using two devices to simultaneously tape the bottom and the top flap panels of a box are described in the Deering, Jr. U.S. Pat. No. 4,238,269.

After the box 122 has been taped, the devices 12 and 14 are ready to engage and apply tape to a subsequent box moving along the predetermined path.

Although the present invention has been described with reference to preferred embodiments, workers skilled in the art will recognize that changes may be made in form and detail without departing from the spirit and scope of the invention.

What is claimed is:

1. A device for applying a length of pressure-sensitive adhesive tape to an object moving along a path past the device, the device comprising:

a frame;

means for applying the length of tape to a periphery of the object, the means for applying being mounted within the frame and being movable between a first tape dispensing position for supplying tape at a selected force and a second tape dispensing position, wherein the means for applying dispenses the tape in a continuous length initially along a forward portion and lastly at a rearward portion of the object in the first position and dispenses the continuous length of tape between the forward and rearward portions of the object at the second position; and means for restricting movement of the means for applying toward the object and thereby reducing the force at which the tape is applied to the object while the tape is applied with the means for applying in the second position.

2. The device of claim 1 wherein the object is a box having a plurality of wall panels and at least two flap panels disposed such that each flap panel has an edge that faces an edge of the other flap panel, and wherein the means for applying is disposed such that in the first position the tape is applied along a first end wall of the box and then is applied along abutting portions of the flap panel edges a first distance, and further dispenses tape for application to the abutting portions of the edges of the flap panel edges while in the second position a second distance, and then dispenses tape for application to a last portion of the abutting portions of the edges and the rearward end wall of the box while in the first position.

3. The device of claim 1 wherein the means for reducing the force includes:

a switching mechanism attached to the frame and actuated by the object moving relative to the means for applying; and a retaining mechanism actuated by the switching mechanism for retaining the means for applying in the second position.

4. The device of claim 3 wherein the switching mechanism includes:

a first switch actuated initially by a leading edge of the object and lastly by a trailing edge of the object;

a second switch actuated by the leading edge of the object; and means for actuating the retaining mechanism operably connected to the first and second switches such that when the first and second switches are actuated by the leading edge of the object, the means for actuating the retaining mechanism moves the retaining mechanism to a retaining position for retaining the means for applying in the second position, and when the first switch is actuated by the trailing edge of the object, the means for actuating the retaining mechanism releases the retaining mechanism from the retaining position.

5. The device of claim 1 and further including:

buffing roller means attached to the frame for engaging the tape after the tape has been dispensed by the means for applying.

6. The device of claim 5 wherein the buffing roller means includes a first buffing roller and a second buffing roller, each roller pivotally attached to the frame along a common pivot axis wherein the first roller engages the tape on a forward portion of the object and the second roller engages the tape on a rearward portion of the object and both rollers engage the tape on an upper surface of the object.

7. The device of claim 1 and further including:

a means for severing the tape movably attached to the frame and actuable to a cutting position for cutting the tape.

8. In a device adapted for applying lengths of pressure-sensitive adhesive coated tape from a supply length of the tape seriatim on the peripheries of spaced rectangular objects driven along a predetermined path in a first direction past the device, the device comprising:

a frame;

an application member having an arcuate periphery;

means adapted for defining a tape route for the supply length of tape to the arcuate periphery of the application member with the adhesive coating disposed away from the application member;

means for mounting said application member on the frame to afford movement thereof from a first tape dispensing position in the path to afford contact between a continuous length of tape disposed adjacent the application member and the leading surface of the object driven along the path in the first direction so that the continuous length of tape is applied at a selected force and adheres to the leading surface of the object, and then to a second tape dispensing position, and then back to the first tape dispensing position;

means mounted on the frame and adapted to be activated by movement of the object past a predetermined position along the path for severing an applied length of tape form the supply length; and means for restricting the movement of the means for mounting the application member towards the object and thereby reducing the force at which the tape is applied to the object while the tape is applied with the application member in the second position.

9. The device of claim 8 wherein the means for reducing the force includes:

a switching mechanism attached to the frame and actuated by the object moving along the predetermined path; and a retaining mechanism actuated by the switching mechanism for retaining the means for applying in the second position.

10. The device of claim 9 wherein the switching mechanism includes:

a first switch actuated initially by the leading surface of the object and lastly by the trailing surface of the object;

a second switch actuated by the leading edge of the object; and means for actuating the retaining mechanism operably connected to the first and second switches such that when the first and second switches are actuated by the leading surface of the object, the means for actuating the retaining mechanism moves the retaining mechanism to retain the means for applying in the second position, and when the first switch is actuated by the trailing edge of the object, the means for actuating the retaining mechanism releases the retaining mechanism from the second position.

11. A method for applying a length of pressure-sensitive adhesive tape to an object moving along a predetermined path past a device that applies a length of tape to an object, the device including an application mechanism that is disposed initially at a first dispensing position, and then is retracted to a second dispensing position, the method comprising:

applying the tape in a continuous length with a first portion of the length of tape being applied to a first leading surface of the object at a selected force at the first dispensing position and then applying a second portion of the continuous length of tape to a mid-portion of the object with the application mechanism disposed in its second dispensing position while restricting movement of the application mechanism towards the object and thereby reducing the force at which the tape is applied to the object, and then applying the continuous length of tape to a trailing surface portion of the object with the application mechanism returning to its first dispensing position.

* * * * *